US008844923B2

(12) United States Patent
Ota et al.

(10) Patent No.: US 8,844,923 B2
(45) Date of Patent: Sep. 30, 2014

(54) SHEET FEEDER AND IMAGE FORMING APPARATUS

(71) Applicant: Canon Kabushiki Kaisha, Tokyo (JP)

(72) Inventors: Sho Ota, Toride (JP); Hajime Sekiguchi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/937,348

(22) Filed: Jul. 9, 2013

(65) Prior Publication Data

US 2014/0042689 A1 Feb. 13, 2014

(30) Foreign Application Priority Data

Aug. 7, 2012 (JP) ..... 2012-175239

(51) Int. Cl.
*B65H 5/00* (2006.01)
*B65H 3/06* (2006.01)

(52) U.S. Cl.
CPC ..... *B65H 3/06* (2013.01)
USPC ..... 271/125; 271/10.13; 271/122

(58) Field of Classification Search
USPC ..... 271/121, 122, 125, 10.01, 10.13
See application file for complete search history.

(56) References Cited

U.S. PATENT DOCUMENTS

| | | | | |
|---|---|---|---|---|
| 6,601,843 | B2 * | 8/2003 | Miki | 271/10.13 |
| 7,185,747 | B2 * | 3/2007 | Cha | 192/46 |
| 7,354,038 | B2 * | 4/2008 | Watase | 271/10.13 |
| 7,641,188 | B2 | 1/2010 | Hiura et al. | |
| 7,900,909 | B2 | 3/2011 | Hiura et al. | |
| 8,430,393 | B2 * | 4/2013 | Matsushima et al. | 271/10.13 |
| 8,480,074 | B2 | 7/2013 | Ubayashi et al. | |
| 8,550,459 | B2 | 10/2013 | Sekiguchi et al. | |
| 2006/0180990 | A1 * | 8/2006 | Ueda et al. | 271/121 |
| 2011/0241285 | A1 | 10/2011 | Sekiguchi | |
| 2011/0272876 | A1 * | 11/2011 | Sugimoto | 271/10.13 |
| 2013/0140758 | A1 | 6/2013 | Ota | |

FOREIGN PATENT DOCUMENTS

JP 4-286558 A 10/1992

* cited by examiner

*Primary Examiner* — Kaitlin Joerger
(74) *Attorney, Agent, or Firm* — Fitzpatrick, Cella, Harper & Scinto

(57) ABSTRACT

The present invention is for separating upper and lower sheets. The sheet feeder includes a feed roller that conveys the sheet fed by a pickup roller in a sheet feeding direction and a retard roller rotated in a sheet feeding direction at a rotational velocity faster than that of the feed roller by interposing a torque limiter. Meanwhile, the retard roller is rotated at a velocity equal to that of the feed roller when a single sheet is nipped in the roller nip portion. The sheet feeder further includes a controller that performs control such that, when double sheet feeding occurs by the pickup roller, the sheet of the retard roller side projects ahead of the sheet of the feed roller side in the sheet feeding direction by virtue of the torque limiter, and then, the retard roller is rotated in a direction opposite to the sheet feeding direction.

10 Claims, 10 Drawing Sheets

SHEET FEEDER AND IMAGE FORMING APPARATUS

BACKGROUND OF THE INVENTION

1. Field of the Invention

The present invention relates to a sheet feeder having a sheet cassette and an image forming apparatus such as a copying machine and a printer having the sheet feeder.

2. Description of the Related Art

In the related art, a sheet feeder used in an image forming apparatus such as a copying machine and a printer has a device capable of separately feeding every single sheet using a retard roller and a feed roller facing each other.

Such a retard roller separation type sheet feeder includes a pickup roller that picks up the sheet, a feed roller rotated in the same direction as that of the pickup roller and provided in a downstream side of a sheet feeding direction, and a retard roller that presses the feed roller with a predetermined pressing force (hereinafter, referred to as a retard pressure). In addition, a sheet is separated in a nip portion (hereinafter, referred to as a roller nip portion) between the feed roller and the retard roller.

The retard roller receives a certain torque in an anti-sheet feeding direction opposite to the sheet feeding direction through a torque limiter so as to be rotated in either the sheet feeding direction or the anti-sheet feeding direction. In addition, in a case where two or more sheets enter the roller nip portion, the retard roller is rotated in the anti-sheet feeding direction, so that it is possible to prevent overlapping feeding of the sheets, in which two or more sheets are overlappingly fed (refer to Japanese Patent Laid-Open No. 04-286558).

However, in the retard roller separation technique including the feeder disclosed in Japanese Patent Laid-Open No. 04-286558, it is difficult to separately feed every single sheet having a cutting failure portion. Here, the cutting failure portion refers to a portion where folding, bending, bulging, or the like is generated in an edge of the cut sheet when a sheet cut transverse section is stretched by a blade used to cut the sheet along a cut direction in the sheet cutting. Since the sheet cutting is performed for a plurality of overlapping sheets, there is a high possibility that a cutting failure portion is generated in the same position of the sheets.

Specifically, the cutting failure portion in front and rear edges of the sheet in the sheet feeding direction can be classified into four types: (1) a state that an upward cutting failure portion exists in a rear end side of the sheet conveying direction; (2) a state that a downward cutting failure portion exists in a leading end side of the sheet conveying direction; (3) a state that a downward cutting failure portion exists in a rear end side of the sheet conveying direction; and (4) a state that an upward cutting failure portion exists in a leading end side of the sheet conveying direction.

Subsequently, a sheet separation state in the states (1) to (4) will be described. Here, an upper sheet refers to a sheet that makes contact with a pickup roller, and a lower sheet refers to a sheet fed to the roller nip portion by virtue of a frictional force from the upper sheet, a resistant force of the cutting failure portion, and the like when the upper sheet is fed by the pickup roller.

In the sheet having two types of cutting failure portions described in the states (1) and (2), the cutting failure portions of the upper and lower sheets are not engaged with each other when the retard roller is rotated in the anti-sheet feeding direction, and the lower sheet moves in the anti-sheet feeding direction. For this reason, the upper and lower sheets are separated in the roller nip portion and are fed one by one.

Meanwhile, in the sheet having two types of cutting failure portions described in the states (3) and (4), the cutting failure portions of the upper and lower sheets are engaged with each other when the retard roller is rotated in the anti-sheet feeding direction, and the lower sheet moves in the anti-sheet feeding direction. For this reason, the upper and lower sheets are resistant to each other when they are separated in the roller nip portion, so that frequency of overlapping feeding increases, in which the sheets are overlappingly fed without separation.

SUMMARY OF THE INVENTION

In view of the problems described above, it is desirable to provide a sheet feeder and an image forming apparatus capable of reliably feeding every single sheet by reliably separating upper and lower sheets regardless of directions of the cutting failure portions of the upper and lower sheets.

According to an aspect of the present invention, there is provided a sheet feeder including: a sheet stacking portion that stacks a plurality of sheets; a feed rotating member that feeds the sheet stacked in the sheet stacking portion; a sheet separating portion having a first rotating member that conveys the sheet fed by the feed rotating member in a sheet feeding direction, and a second rotating member rotated in a sheet feeding direction at a rotational velocity faster than that of the first rotating member by interposing a torque limiter, the second rotating member being rotated at a velocity equal to that of the first rotating member when a single sheet is fed by the feed rotating member; a drive portion that drives the sheet separating portion; and a controller that controls the drive portion such that, when a plurality of sheets is fed by the feed rotating member, the sheet of the second rotating member side projects ahead of the sheet of the first rotating member side in the sheet feeding direction by virtue of the torque limiter, and then, the second rotating member is rotated in a direction opposite to the sheet feeding direction.

According to the present invention, when a plurality of sheets is fed, the sheet making contact with the second rotating member is made to project ahead of the sheet of first rotating member side and is then returned in the opposite direction. Therefore, it is possible to reliably disengage the overlapping cutting failure portions of the upper and lower sheets. As a result, it is possible to reliably separate and feed every single sheet regardless of a direction of the cutting failure portion.

Further features of the present invention will become apparent from the following description of exemplary embodiments with reference to the attached drawings.

DESCRIPTION OF THE EMBODIMENTS

Figure 1:
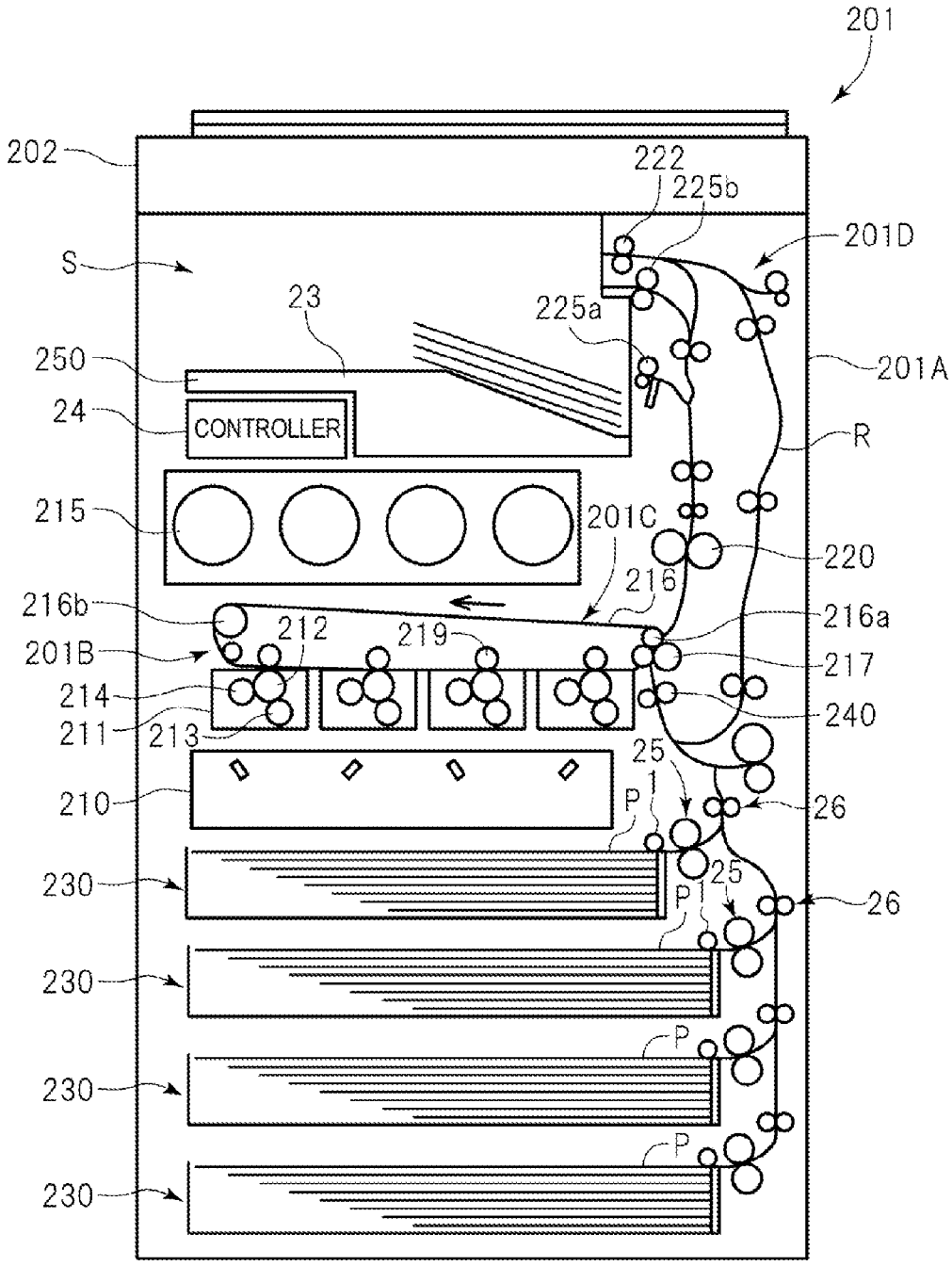
FIG. 1 is a schematic cross-sectional view illustrating a laser beam printer as an image forming apparatus according to the present invention.

Hereinafter, embodiments of the present invention will be described in detail with reference to the accompanying drawings. First, an image forming apparatus having a sheet feeder will be described with reference to FIG. 1. FIG. 1 is a schematic cross-sectional view illustrating a laser beam printer as an image forming apparatus according to the present invention.

First Embodiment

As illustrated in FIG. 1, a laser beam printer 201 (hereinafter, referred to as a printer) as a full-color image forming apparatus has a printer main body 201A (hereinafter, referred to as an apparatus main body) as a main body of the image forming apparatus. The apparatus main body 201A includes an image forming portion 201B that forms an image on a sheet P, a fixing portion 220, and an image reader 202 as an upper device provided approximately horizontally over the apparatus main body 201A. The apparatus main body 201A is provided with a controller 24 for collectively controlling each portion in the apparatus.

A sheet discharge space S for discharging sheets is formed between the image reader 202 and the apparatus main body 201A. Under the sheet discharge space S, a toner cartridge 215 is arranged. Under the apparatus main body 201A, a plurality of sheet stacking portions 230 is arranged for stacking the sheets P.

A drum full-color type is employed in the image forming portion 201B. The image forming portion 201B includes a laser scanner 210 and four process cartridges 211 that form four-color toner images including yellow (Y), magenta (M), cyan (C), and black (K).

Here, each process cartridge 211 includes a photosensitive drum 212 as a photosensitive member, an electric charger 213 as an electric charging portion, a development device 214 as a development portion, and a cleaner (not illustrated) as a cleaning portion. In addition, the image forming portion 201B has an intermediate transfer unit 201C over the process cartridge 211.

The intermediate transfer unit 201C has an intermediate transfer belt 216 as an image bearing member looped around a drive roller 216*a* and a tension roller 216*b*. In addition, the intermediate transfer unit 201C has a primary transfer roller 219 that is provided in the inside of the intermediate transfer belt 216 and abuts on an inner surface of the intermediate transfer belt 216 in a position facing the photosensitive drum 212. The intermediate transfer belt 216 is made of a film-like member and abuts on each photosensitive drum 212. The intermediate transfer belt 216 is rotated in an arrow direction by virtue of the drive roller 216*a* driven by a drive portion (not illustrated).

By applying a positive transfer bias from the primary transfer roller 219 to the intermediate transfer belt 216, each color toner image having a negative polarity on the photosensitive drum 212 is sequentially multi-transferred onto the intermediate transfer belt 216. As a result, a color image is formed on the intermediate transfer belt. In addition, a secondary transfer roller 217 serving as a secondary transfer portion that transfers the color image formed on the intermediate transfer belt onto a sheet P is provided in a position facing the drive roller 216*a* in the intermediate transfer unit 201C.

The fixing portion 220 is arranged over the secondary transfer roller 217, and a pair of first discharge rollers 225*a*, a pair of second discharge rollers 225*b*, and a both-side reversing portion 201D as a reverse sheet discharge portion are arranged in a upper left side of the fixing portion 220. This both-side reversing portion 201D includes a pair of reversing rollers 222 as a sheet reverse conveying roller capable of forwardly or backwardly conveying the sheet, a return path R for conveying the sheet having an image on one surface to the image forming portion 201B again, and the like.

In the downstream side of the sheet feeding direction of each sheet stacking portion 230, a pair of separating rollers 25 as a sheet separating portion including a pickup roller 1, a feed roller 2, and a retard roller 3 is arranged. In the downstream side of the pair of separating rollers 25, a pair of conveying rollers 26 that convey the received sheet P to the secondary transfer portion is arranged.

Figure 2:
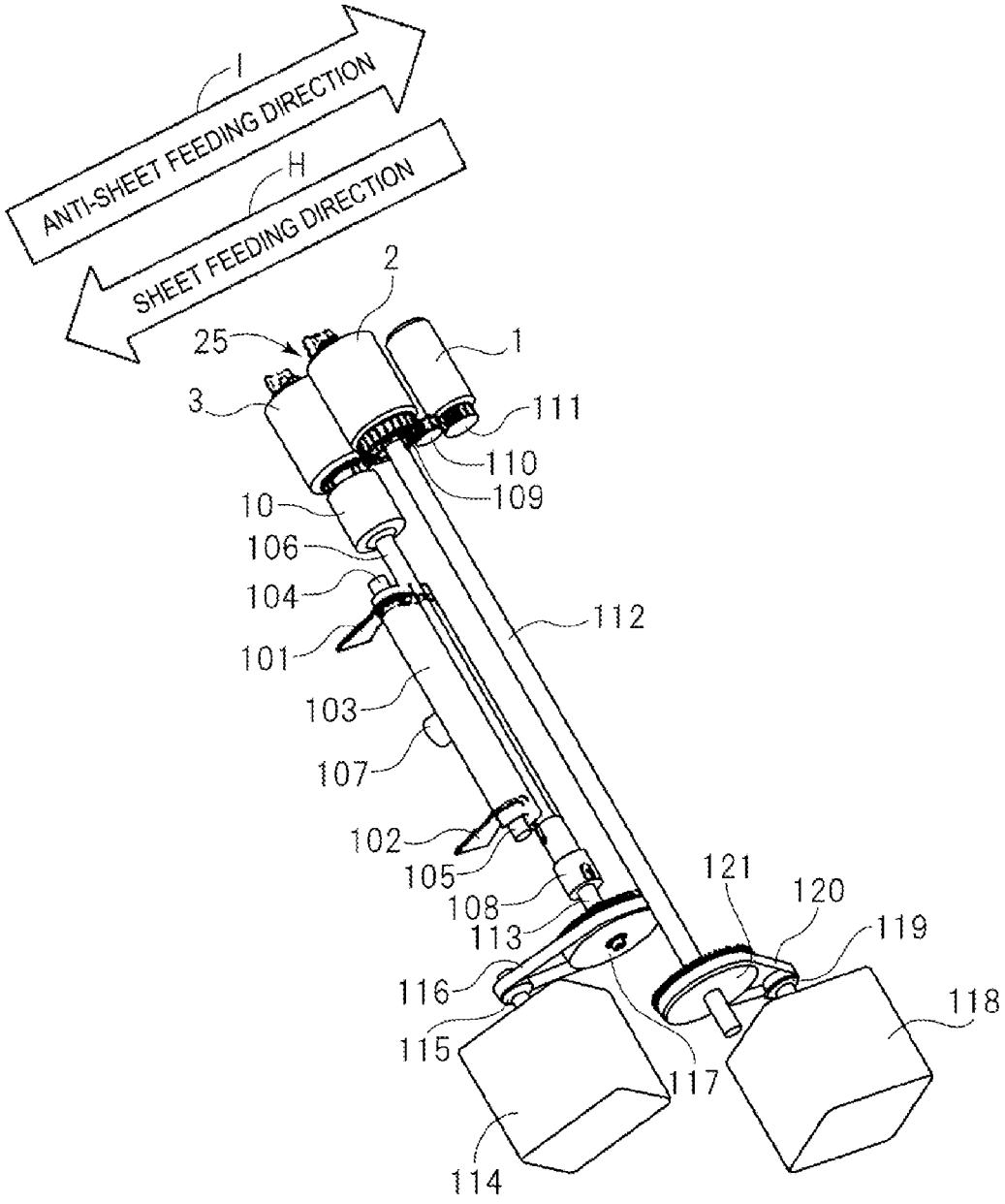
FIG. 2 is a perspective diagram illustrating a main configuration of a retard roller separation type sheet feeder according to a first embodiment of the present invention.
Figure 3:
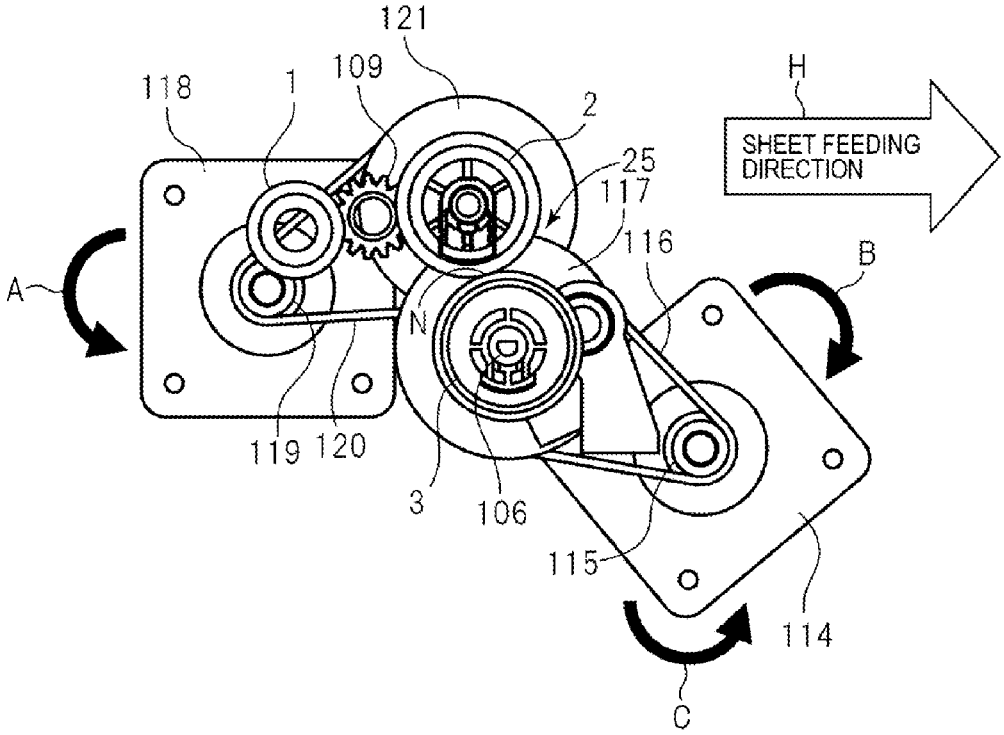
FIG. 3 is a front view illustrating a main configuration of the retard roller separation type sheet feeder according to the first embodiment.

Subsequently, the sheet feeder according to the present embodiment will be described. FIG. 2 is a perspective view illustrating a main configuration of the retard roller separation type sheet feeder according to the present embodiment. FIG. 3 is a front view illustrating a main configuration of the retard roller separation type sheet feeder according to the present embodiment. FIGS. 4A to 4D are explanatory diagrams illustrating operations when the sheet is separated in the roller nip portion N.

First, a drive mechanism that drives the pair of separating rollers 25 will be described. The feed roller 2 serves as a first rotating member that conveys the sheet fed by the pickup roller 1 as a feed rotating member which is a sheet feeding portion in the sheet feeding direction H. The retard roller 3 serves as a second rotating member that rotates in the sheet feeding direction at a rotational velocity faster than that of the feed roller 2 by interposing a torque limiter 10. Meanwhile, the retard roller 3 rotates at the same rotational velocity as that of the feed roller 2 when a single sheet is fed by the pickup roller 1. In addition, the sheet feeder includes the sheet stacking portion 230, the pair of separating rollers 25, the pickup roller 1, and the like.

As illustrated in FIG. 2, the drive mechanism includes a feed roller drive shaft 112 having one end connected to a center of the feed roller 2 and a pulley 121 installed in the other end of the feed roller drive shaft 112. In addition, the drive mechanism has a feed roller drive motor 118 supported by a main body frame (not illustrated).

A driving pulley 119 is installed in a rotational shaft of the feed roller drive motor 118, and a driving belt 120 is looped between the driving pulley 119 and the pulley 121. Rotation of the feed roller 2 is transmitted to a pickup roller gear 111, that is, the pickup roller 1 through an input gear 109 meshing with a gear portion of the feed roller 2. The pickup roller 1 servers as a feed rotating member that feeds the sheets stacked on the sheet stacking portion 230.

Furthermore, the drive mechanism includes a retard roller drive shaft 106 having one end connected to a center of the retard roller 3 by interposing a torque limiter 10 and a pulley 117 installed in the other end of the retard roller drive shaft 106 by interposing a coupling 108. In addition, the drive mechanism has a retard roller drive motor 114 supported by a main body frame (not illustrated). A driving pulley 115 is installed in a rotational shaft of the retard roller drive motor 114, and a driving belt 116 is looped between the driving pulley 115 and the pulley 117.

A driving portion that drives the pair of separating rollers 25 as a sheet separating portion includes the retard roller drive motor 114 as a first drive motor and the feed roller drive motor 118 as a second drive motor.

The drive mechanism has a retard roller pressing member 103 supported by a main body frame (not illustrated) to extend in parallel with the retard roller drive shaft 106 in a center portion of the retard roller drive shaft 106. The retard roller drive shaft 106 is axially supported by the retard roller pressing member 103.

The retard roller pressing member 103 is rotatably supported by the first and second support plates 101 and 102 having first and second shaft portions 104 and 105, respectively, fixed to the main body frame. A center of the retard roller pressing member 103 is pressed by a spring 107 along with the retard roller drive shaft 106 toward the feed roller 2 at all times.

The feed roller drive motor 118 is rotated in an arrow direction A (clockwise direction in FIG. 2) of FIG. 3. This rotation is transmitted to the pulley 121 through the driving pulley 119 installed in the rotational shaft of the feed roller drive motor 118 and the driving belt 120 looped around the driving pulley 119. In addition, the feed roller drive shaft 112 axially supported by a main body frame (not illustrated) is rotated by the pulley 121, so that rotation is transmitted to the feed roller 2. In this manner, the feed roller 2 and the pickup roller 1 are rotated by driving the feed roller drive motor 118.

Rotation is transmitted from the retard roller drive motor 114 to the pulley 117 through the driving pulley 115 and the driving belt 116. Furthermore, this rotation is transmitted to the retard roller drive shaft 106 through the coupling 108. Meanwhile, rotation of the retard roller drive shaft 106 is transmitted to the retard roller 3 through the torque limiter 10.

The retard roller drive motor 114 causes the retard roller 3 to rotate in a direction where the sheet is fed in the sheet feeding direction H (clockwise direction in FIG. 3) as it rotates in an arrow direction B of FIG. 3. In addition, the retard roller drive motor 114 causes the retard roller 3 to rotate in a direction where the sheet is fed in an anti-sheet feeding direction I (FIG. 2) (counterclockwise direction in FIG. 3) opposite to the sheet feeding direction as it rotates in an arrow direction C of FIG. 3.

Hereinafter, rotation in a direction where the sheet is fed in the sheet feeding direction H is referred to as rotation in a sheet feeding direction, and rotation in a direction where the sheet is fed in the anti-sheet feeding direction I is referred to as rotation in an anti-sheet feeding direction.

As described above, the retard roller drive shaft 106 according to the present embodiment switches between forward rotation and backward rotation as the retard roller drive motor 114 switches between forward rotation and backward rotation under control of the controller 24.

In a configuration for preventing overlapping feeding by rotating the retard roller 3 using the torque limiter 10 arranged in the retard roller drive shaft 106, the employed torque limiter 10 is configured to run idle in a case where a certain torque or higher is applied in forward and backward rotational directions.

In a case where a single sheet enters the roller nip portion N, a high load is applied to the retard roller 3 from the sheet. For this reason, transmission of a drive force of the torque limiter 10 is interrupted, and the retard roller 3 follows the sheet, so that the sheet is rotated in a direction where the sheet is fed in the sheet feeding direction H.

Meanwhile, in a case where a plurality of sheets enters the roller nip portion N, since a low load is applied to the retard roller 3 from the sheet, transmission of a drive force of the torque limiter 10 is not interrupted. Therefore, the retard roller 3 is rotated in a direction where the sheet is fed in the anti-sheet feeding direction I so as to sequentially return the sheets from the sheet of the retard roller side to separate every single sheet.

Figure 5:
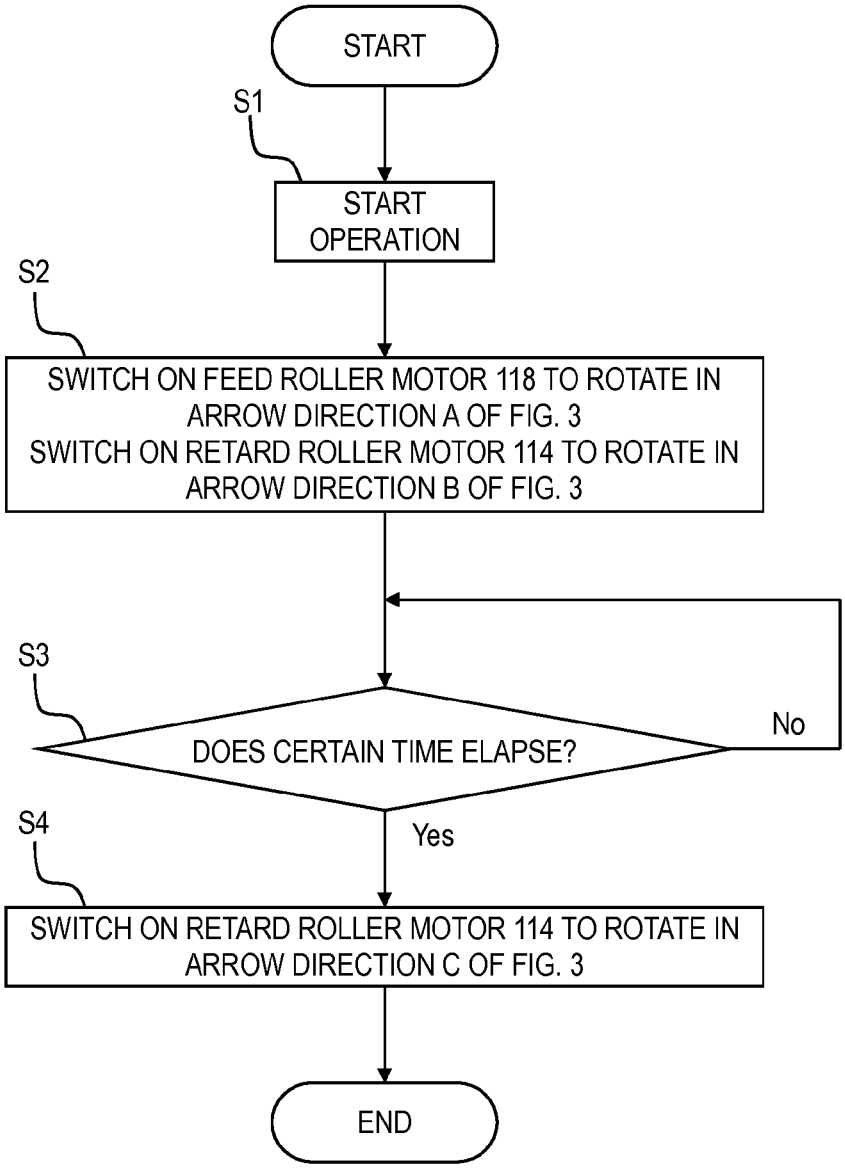
FIG. 5 is a flowchart illustrating operations according to the first embodiment.

Next, a sheet feeding operation according to the present embodiment will be described. FIG. 5 is a flowchart illustrating operations according to the present embodiment.

First, if a feeding process starts as illustrated in FIG. 5, the controller 24 performs control such that the feeding operation (S1) starts to causes the pickup roller 1 to abut on a sheet top surface by operating a solenoid (not illustrated).

Subsequently, in step S2, the controller 24 causes the feed roller drive motor 118 to start to rotate in the arrow direction A (forward rotation) of FIG. 3, the feed roller 2 and the pickup roller 1 are rotated in a direction where the sheet is fed in the sheet feeding direction H (counterclockwise direction in FIG. 3).

In addition, the controller 24 causes the retard roller drive motor 114 to start to rotate in the arrow direction B (forward rotation) of FIG. 3. In this case, the controller 24 performs control to make rotation in a direction where the sheet is fed in the sheet feeding direction H such that a circumferential velocity of the retard roller 3 in the sheet feeding direction in the roller nip portion is faster than that of the feed roller 2 in the sheet feeding direction in the roller nip portion. As a result, the feed roller 2, the pickup roller 1, and the retard roller 3 are simultaneously rotated in a direction where the sheet is fed in the sheet feeding direction H.

As a leading end of the sheet enters the roller nip portion N using the pickup roller 1, the controller 24 switches a rotational direction of the retard roller drive motor 114 to the arrow direction C of FIG. 3 (S4) at a predetermined timing (S3). That is, the controller 24 switches a rotational direction of the retard roller drive motor 114 to the arrow direction C of FIG. 3 when a predetermined time elapses after the leading end of the sheet enters the roller nip portion N from the start of rotation of the feed roller drive motor 118. In this manner, in a case where a plurality of sheets is fed by the pickup roller 1, the controller 24 according to the present embodiment determines a timing for returning a temporarily projecting sheet of the retard roller 3 side to the opposite direction as a predetermined time elapsing.

The controller 24 switches rotation of the retard roller 3 to a direction where the sheet is fed in the anti-sheet feeding direction I and then stops the feeding operation. In addition, the switching timing of the retard roller 3 may not be determined as a predetermined time elapsing. Instead, a detection member for detecting whether or not the sheet enters the roller nip portion N may be arranged, and the switching may be performed based on detection of the detection member.

When only a single sheet is conveyed to the roller nip portion N at the time of sheet feeding, the torque limiter 10 arranged coaxially with the retard roller 3 runs idle along the sheet. For this reason, the retard roller 3 is rotated along with the feed roller 2 in a direction where the sheet is fed to send the sheet.

Meanwhile, when two or more sheets are conveyed to the roller nip portion N, the sheet of the lower side that does not make contact with the feed roller 2 is temporarily fed to the sheet feeding direction by virtue of a torque applied from the torque limiter 10, and then, the retard roller 3 backwardly rotates the sheet in the anti-sheet feeding direction. For this reason, the sheet that does not make contact with the feed roller 2 can be returned to the inside of the sheet stacking portion 230, so that every single sheet is separately conveyed.

Figure 9A:
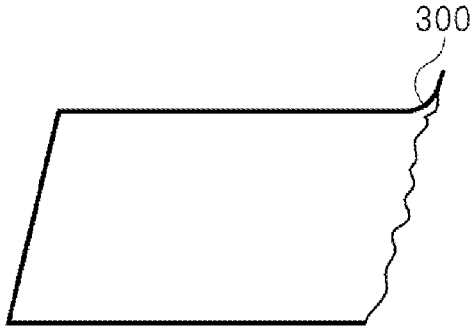
FIG. 9A is an explanatory diagram illustrating cutting failure portions in front and rear edges of a sheet feeding direction.

Here, a feeding failure generated by a cutting failure in a case where the present invention is not applied will be described with reference to FIGS. 9 and 10. FIG. 9A is an explanatory diagram illustrating a cutting failure portions in the front and rear edges of the sheet in the sheet feeding direction, and FIGS. 9B to 9E are schematic diagrams illustrating the cutting failure portions in the front and rear edges of the sheet in the sheet feeding direction. FIG. 10 is an explanatory diagram illustrating a state of the sheet separated from the roller nip portion.

That is, in the retard roller separation type where the present invention is not applied, it is difficult to separately feed every single sheet having the cutting failure portion 300 of FIG. 9A. The cutting failure portion is a portion where folding, bending, bulging, and the like is generated in the cut sheet when a sheet cut transverse section is stretched by a blade for cutting the sheet along a cut direction in the sheet cutting. Since the sheet cutting is overlappingly performed for a plurality of sheets, there is a high possibility that there is a cutting failure portion in the same position of the sheet.

FIGS. 9B to 9E schematically illustrate the cutting failure portion 300 in a state that a pair of sheets having upward and downward cutting failure portions in the front and rear edges, respectively, of the sheet feeding direction is overlapped. That is, the cutting failure portions of the front and rear edges of the sheet in the sheet feeding direction are classified into four types as illustrated in FIGS. 9B to 9E.

Figure 9B:
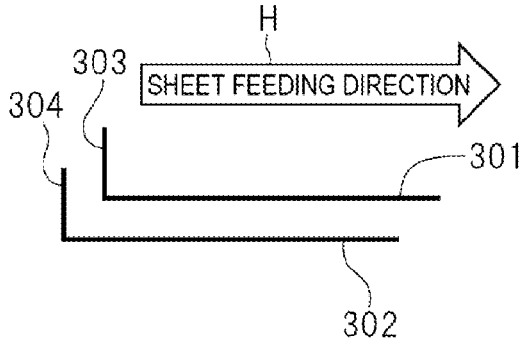
FIGS. 9B to 9E are schematic diagrams illustrating cutting failure portions in front and rear edges of the sheet feeding direction.
Figure 9C:
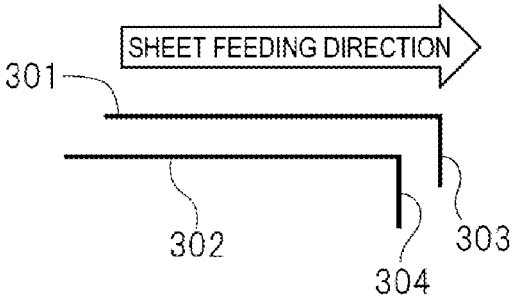
Figure 9D:
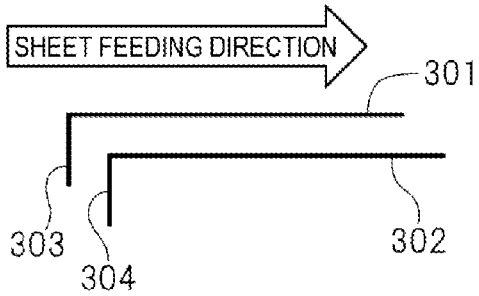
Figure 9E:
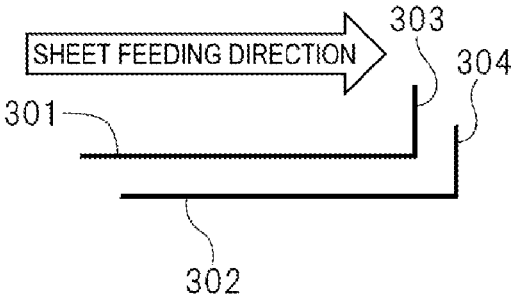

FIG. 9B illustrates a state that there is an upward cutting failure portion in the rear edge side in the sheet conveying direction. FIG. 9C illustrates a state that there is a downward cutting failure portion in the leading edge side of the sheet conveying direction. FIG. 9D illustrates a state that there is a downward cutting failure portion in the rear edge side of the sheet conveying direction. FIG. 9E illustrates a state that there is an upward cutting failure portion in the leading end side of the sheet conveying direction.

In FIGS. 9B to 9E, the upper sheet 301 is a sheet making contact with the pickup roller. In addition, the lower sheet 302 is a sheet fed to the roller nip portion by virtue of a frictional force of the upper sheet 301, a resistant force of the cutting failure portion, and the like when the upper sheet 301 is fed by the pickup roller.

In a sheet having two types of cutting failure portions illustrated in FIGS. 9B and 9C, the upper sheet cutting failure portion 303 and the lower sheet cutting failure portion 304 are not engaged with each other even when the retard roller is rotated in the anti-sheet feeding direction, and the lower sheet 302 moves in the anti-sheet feeding direction. For this reason, every single sheet is separately fed in the roller nip portion.

Meanwhile, in a sheet having two types of cutting failure portions illustrated in FIGS. 9D and 9E, the cutting failure portions 303 and 304 of the upper and lower sheets are engaged with each other when the retard roller is rotated in the anti-sheet feeding direction, and the lower sheet 302 moves in the anti-sheet feeding direction. For this reason, resistance is generated when the upper and lower sheets 301 and 302 are separated from each other in the roller nip portion, so as to increase frequency of overlapping feeding in which the sheets are overlappingly fed without being separated from each other.

Next, a case where a sheet has the cutting failure portion of FIG. 9E in the sheet feeding direction due to a cutting failure will be described with reference to FIG. 4.

In FIG. 9E, there are upward cutting failure portions 303 and 304 in the leading edge sides of the sheet feeding direction of two overlapping sheets. Here, although description is made for a sheet having the cutting failure portion of FIG. 9E, the same applies to the sheets having downward cutting failure portions 303 and 304 in the rear edge as illustrated in FIG. 9D.

Figure 4A:
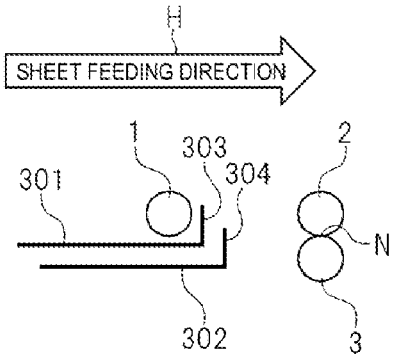
FIGS. 4A to 4D are explanatory diagrams illustrating operations when sheets are separated in the roller nip portion.
Figure 4B:
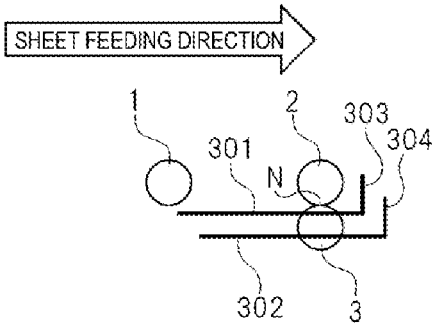

That is, by feeding the leading edge of the sheet to the roller nip portion N using the pickup roller 1 as illustrated in FIG. 4A and rotating the retard roller 3 in the sheet feeding direction using the retard roller drive motor 114, the sheet reliably enters the roller nip portion N as illustrated in FIG. 4B.

Figure 4C:
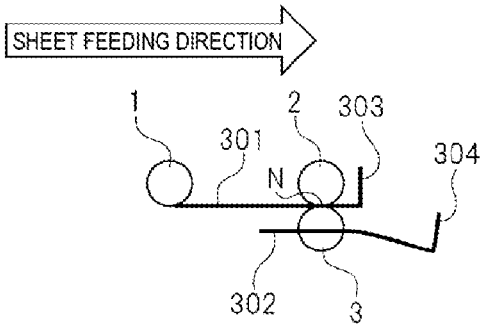

Subsequently, in a case where the lower sheet 302 moves to the sheet feeding direction, the lower sheet 302 is separated from the upper sheet 301 because the cutting failure portion 303 of the upper sheet is not engaged with the cutting failure portion 304 of the lower sheet. For this reason, the lower sheet 302 moves in the sheet feeding direction ahead of the upper sheet 301 as illustrated in FIG. 4C because the retard roller 3 is rotated faster than the feed roller 2.

In this case, an engaging portion between the temporarily separated cutting failure portions 303 and 304 is slightly deformed, and deformation modes thereof are different from each other. In addition, the retard roller 3 switches to rotation in the anti-sheet feeding direction as rotation of the retard roller drive motor 114 is reversed at a predetermined timing, that is, when the leading edge of the sheet enters the roller nip portion N at a predetermined time elapsing from the start of rotation of the feed roller drive motor 118.

Figure 4D:
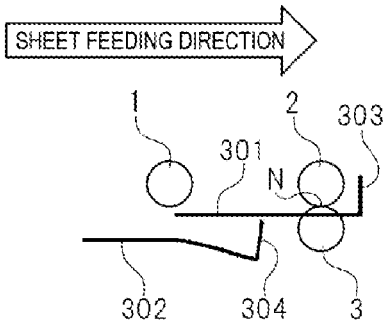

In this case, since the engaging portions are differently deformed, the cutting failure portions 303 and 304 of the upper and lower sheets are not engaged unlike a state before the separation. For this reason, the upper and lower sheets 301 and 302 are separately returned and fed one by one as illustrated in FIG. 4D. The cutting failure portions of FIGS. 9B and 9C may also be separated using the configuration of the related art.

Figure 10A:
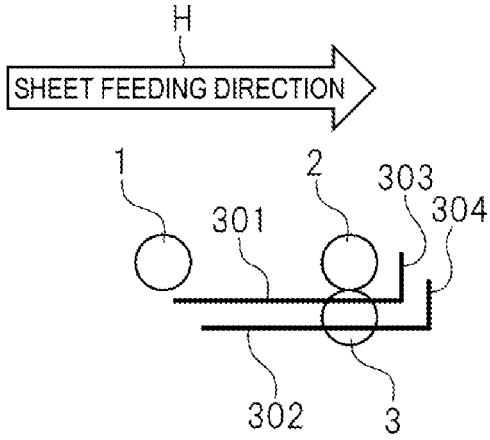
FIGS. 10A to 10C are schematic diagrams illustrating a state of the sheet separated in the roller nip portion.
Figure 10B:
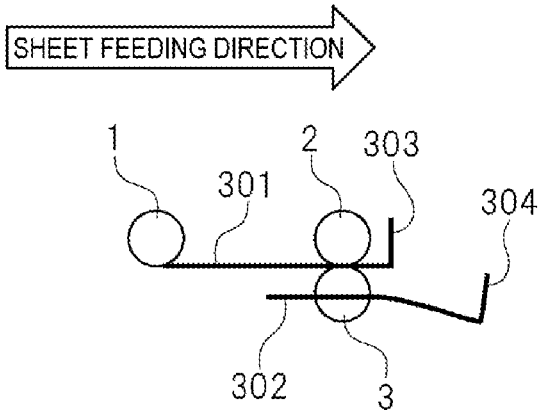

That is, in a case where a pair of sheets 301 and 302 is fed to the roller nip portion N as illustrated in FIG. 10A, the processing is performed as follows. Specifically, when a velocity of the retard roller 3 in the sheet feeding direction on the roller nip portion is faster than that of the feed roller 2, the lower sheet 302 is moved by the retard roller 3 in the sheet feeding direction as illustrated in FIG. 10B.

Figure 10C:
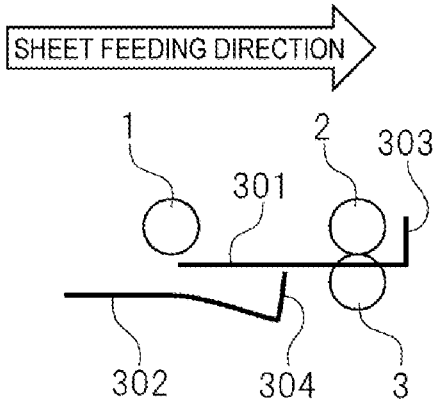

The cutting failure portions are slightly deformed once they are separated. Since deformation modes thereof are different from each other, the shape of the cutting failure portion 303 of the upper sheet does not match the shape of the cutting failure portion 304 of the lower sheet. Accordingly, after the retard roller 3 is switched to rotation of the anti-sheet feeding direction, the cutting failure portions 303 and 304 of the upper and lower sheets 301 and 302 are not engaged with each other, and the sheets are separately fed one by one as illustrated in FIG. 10C.

In addition, according to the present embodiment, a velocity of the retard roller 3 in the anti-sheet feeding direction on the roller nip portion is set to be slower than a velocity of the feed roller 2 when the retard roller 3 is rotated in the anti-sheet feeding direction. As a result, it is possible to reduce a load on the retard roller drive motor 114 as an actuator.

According to the present embodiment, using the controller 24, a circumferential velocity (rotational velocity) of the retard roller 3 in the anti-sheet feeding direction in the roller nip portion is set to be slower than a circumferential velocity of the feed roller 2 in the roller nip portion N. For this reason, it is possible to reduce a load applied to the retard roller drive motor 114 when the lower sheet 302 is reversed and returned.

According to the present embodiment, when a plurality of sheets is fed by the pickup roller 1, the sheet of the retard roller side (second rotating member side) protrudes ahead of the sheet of the feed roller side (first rotating member side) in the sheet feeding direction by virtue of the torque limiter 10. Then, the controller 24 controls the feed roller drive motor 118 and the retard roller drive motor 114 as a drive portion such that the retard roller 3 is rotated in a direction opposite to the sheet feeding direction.

According to the present embodiment, a velocity of the retard roller 3 in the sheet feeding direction on the roller nip portion is set to be faster than a velocity of the feed roller 2 in the sheet feeding direction on the roller nip portion. For this reason, in the case of sheets 301 and 302 having two types of cutting failure portions 303 and 304 of FIGS. 9D and 9E, the cutting failure portions 303 and 304 are not engaged with each other when the retard roller 3 is rotated in the sheet feeding direction, and the lower sheet 302 moves in the sheet feeding direction. Therefore, as the lower sheet 302 is separated from the upper sheet 301, the lower sheet 302 temporarily moves ahead of the upper sheet 301 in the sheet feeding direction.

According to the present embodiment described above, when a plurality of sheets is fed, a sheet making contact with the retard roller 3 is made to project ahead of the sheet of the feed roller 2 side and is returned in an opposite direction. For this reason, it is possible to reliably disengage the overlapping cutting failure portions 303 and 304 of the upper and lower sheets. As a result, it is possible to reliably separate the sheets and reliably feed every single sheet regardless of a direction of the cutting failure portion.

Second Embodiment

Figure 6:
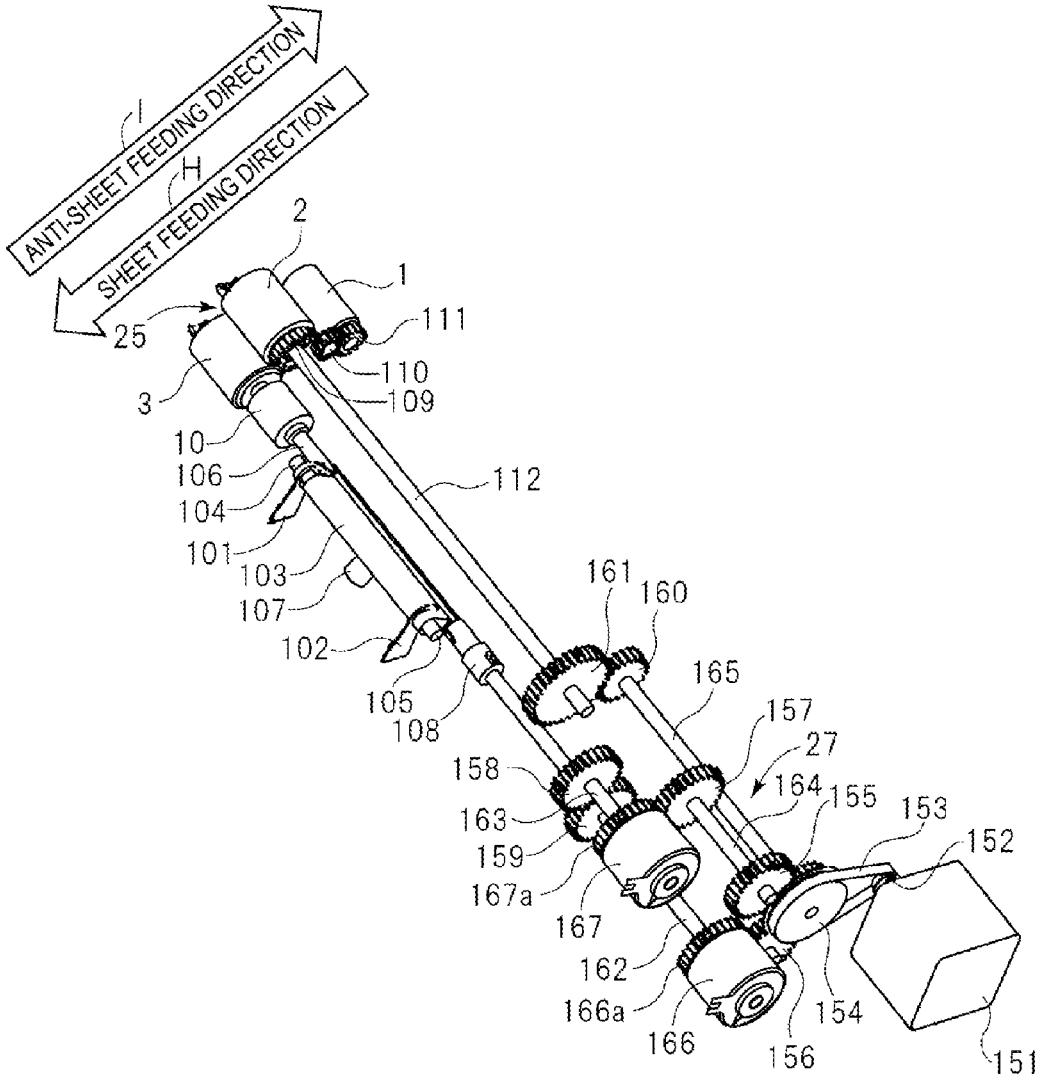
FIG. 6 is a perspective view illustrating a main configuration of the retard roller separation type sheet feeder according to a second embodiment of the present invention.
Figure 7:
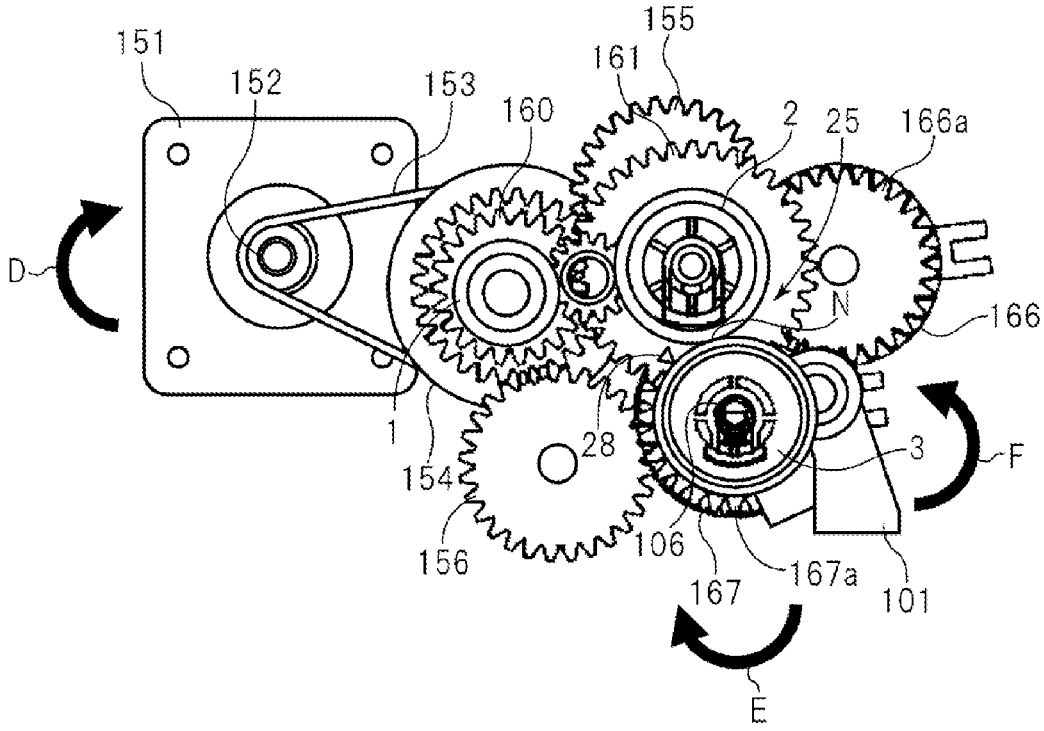
FIG. 7 is a front view illustrating a main configuration of the retard roller separation type sheet feeder according to the second embodiment.

Next, a second embodiment according to the present invention will be described. FIG. 6 is a perspective view illustrating a main configuration of a retard roller separation type sheet feeder according to the present embodiment. FIG. 7 is a front view illustrating a main configuration of the retard roller separation type sheet feeder according to the present embodiment. In the present embodiment, like reference numerals denote like elements as in the first embodiment, and description thereof will not be repeated.

First, a drive transmission configuration according to the present embodiment will be described. Specifically, as illustrated in FIG. 6, a drive motor 151 supported by a main body frame (not illustrated) is configured to be rotatably driven only in a counterclockwise direction of FIG. 6 (in an arrow direction D of FIG. 7) under control of the controller 24. The drive motor 151 generates rotation in a feed roller 2 as a first rotating member, a retard roller 3 as a second rotating member, and a pickup roller 1 as a feed rotating member.

A drive mechanism according to the present embodiment includes a feed roller drive shaft 112 having one end connected to a center of the feed roller 2 and a seventh gear 161 installed in the other end of the feed roller drive shaft 112. This drive mechanism drives a pair of separating rollers 25 including the feed roller 2 (first rotating member) and the retard roller 3 (second rotating member).

In addition, the drive mechanism includes a retard roller drive shaft 106 having one end connected to a center of the retard roller 3 through a torque limiter 10 and a first shaft 162 connected to the other end of the retard roller drive shaft 106 through a coupling 108. In addition, the drive mechanism has a retard roller pressing member 103 supported by a main body frame (not illustrated) to extend in parallel with the retard roller drive shaft 106 in a center portion of the retard roller drive shaft 106. The retard roller drive shaft 106 is axially supported by the retard roller pressing member 103.

Furthermore, the drive mechanism includes a fourth drive shaft 165 supported to extend in an extending direction of the feed roller drive shaft 112 and a third shaft 164 extending in parallel with the fourth drive shaft 165. A sixth gear 160 meshing with the seventh gear 161 is installed in one end of the fourth drive shaft 165, and a pulley step gear 154 having a back surface where a gear portion integrated is installed in the other end of the fourth drive shaft 165. A third gear 157 is installed in one end of the third shaft 164, and a first gear 155 is installed in the other end of the third shaft 164.

A motor pulley 152 is installed in a rotational shaft of the drive motor 151. A driving belt 153 having an endless shape is looped between the motor pulley 152 and the pulley step gear 154 close thereto.

A fifth gear 159 is installed in a center portion of the first shaft 162 connected to the retard roller drive shaft 106 through the coupling 108, and a retard roller forward-rotation electromagnetic clutch 166 is installed in the other end of the first shaft 162. In addition, a fourth gear 158 is installed in one end of the second shaft 163 supported by a main body frame (not illustrated) in parallel with the first shaft 162, and a retard roller backward-rotation electromagnetic clutch 167 is installed in the other end of the second shaft 163.

The pulley step gear 154 meshes with the first gear 155 installed in the other end of the third shaft 164. Meanwhile, the pulley step gear 154 is synchronized with the forward-rotation electromagnetic clutch gear portion 166*a* by interposing the second gear 156 supported by a main body frame (not illustrated). The third gear 157 installed in one end of the third shaft 164 meshes with the backward-rotation electromagnetic clutch gear portion 167*a*. The fourth gear 158 arranged coaxially with the backward-rotation electromagnetic clutch gear portion 167*a* meshes with the fifth gear 159.

A gear mechanism that transmits rotation from the drive motor 151 to the retard roller 3 and the pickup roller 1 includes the pulley step gear 154, the sixth and seventh gears 160 and 161, the input gear 109, and the idler gear 110. In addition, a clutch mechanism that transmits rotation from the drive motor 151 to the retard roller 3 by switching between rotation of a sheet feeding direction and rotation of a direction opposite thereto includes the retard roller forward-rotation electromagnetic clutch 166 and the retard roller backward-rotation electromagnetic clutch 167. In addition, a drive portion includes the drive motor 151, the gear mechanism 27, the retard roller forward-rotation electromagnetic clutch 166, and the retard roller backward-rotation electromagnetic clutch 167.

In the drive mechanism having the aforementioned configuration, as the drive motor 151 is rotated, the rotation thereof is transmitted to the pulley step gear 154 through the motor pulley 152 and the driving belt 153. In addition, rotation of the pulley step gear 154 is transmitted to the backward-rotation electromagnetic clutch gear portion 167*a* through the first gear 155 and the third gear 157 and is transmitted to the forward-rotation electromagnetic clutch gear portion 166*a* through the second gear 156. In addition, rotation of the drive motor 151 is transmitted to the feed roller 2 through the fourth drive shaft 165, the sixth gear 160, the seventh gear 161, and the feed roller drive shaft 112 as rotation of the sheet feeding direction.

As the retard roller forward-rotation electromagnetic clutch 166 is switched on or off under control of the controller 24, transmission of rotation from the drive motor 151 to the first shaft 162 is switched. As a result, forward rotation from the drive motor 151 to the retard roller 3 is switched between a transmission state and a cut-off state.

In a case where the retard roller backward-rotation electromagnetic clutch 167 is switched off, and the retard roller forward-rotation electromagnetic clutch 166 is switched on, rotation in a counterclockwise direction of FIG. 6 (arrow direction E of FIG. 7) is transmitted from the second gear 156 to the first shaft 162. Furthermore, this rotation is transmitted to the retard roller drive shaft 106 through the coupling 108 on the first shaft 162, and the retard roller 3 is rotated in the sheet feeding direction.

Since the retard roller backward-rotation electromagnetic clutch 167 is switched on or off under control of the controller 24, transmission of rotation from the drive motor 151 to the second shaft 163 is switched. As a result, reverse rotation (backward rotation) from the drive motor 151 to the retard roller 3 is switched between a transmission state and a cut-off state.

In a case where the retard roller forward-rotation electromagnetic clutch 166 is switched off, and the retard roller backward-rotation electromagnetic clutch 167 is switched on, rotation of a clockwise direction of FIG. 6 (arrow direction F of FIG. 7) is transmitted from the third gear 157 through the second shaft 163, the fourth gear 158, the fifth gear 159, and the coupling 108 to the retard roller drive shaft 106. This rotation of the retard roller drive shaft 106 is transmitted to the retard roller 3 as rotation of the anti-sheet feeding direction.

Next, a relationship between the number of teeth of the gear and the roller diameter will be described. That is, according to the present embodiment, the number of teeth of the sixth gear 160 is greater than that of the seventh gear 161, so that the rotation number of the feed roller drive shaft 112 is smaller than that of the fourth shaft 165. In addition, the pulley step gear 154, the first gear 155, the second gear 156, the third gear 157, the fourth gear 158, the fifth gear 159, the forward-rotation electromagnetic clutch gear portion 166*a*, and the backward-rotation electromagnetic clutch gear portion 167*a* have the same number of teeth.

In addition to this configuration, the feed roller 2 and the retard roller 3 have the same diameter. As a result, when the retard roller 3 is rotated in the sheet feeding direction, it is possible to rotate the retard roller 3 faster than the feed roller 2.

Figure 8:
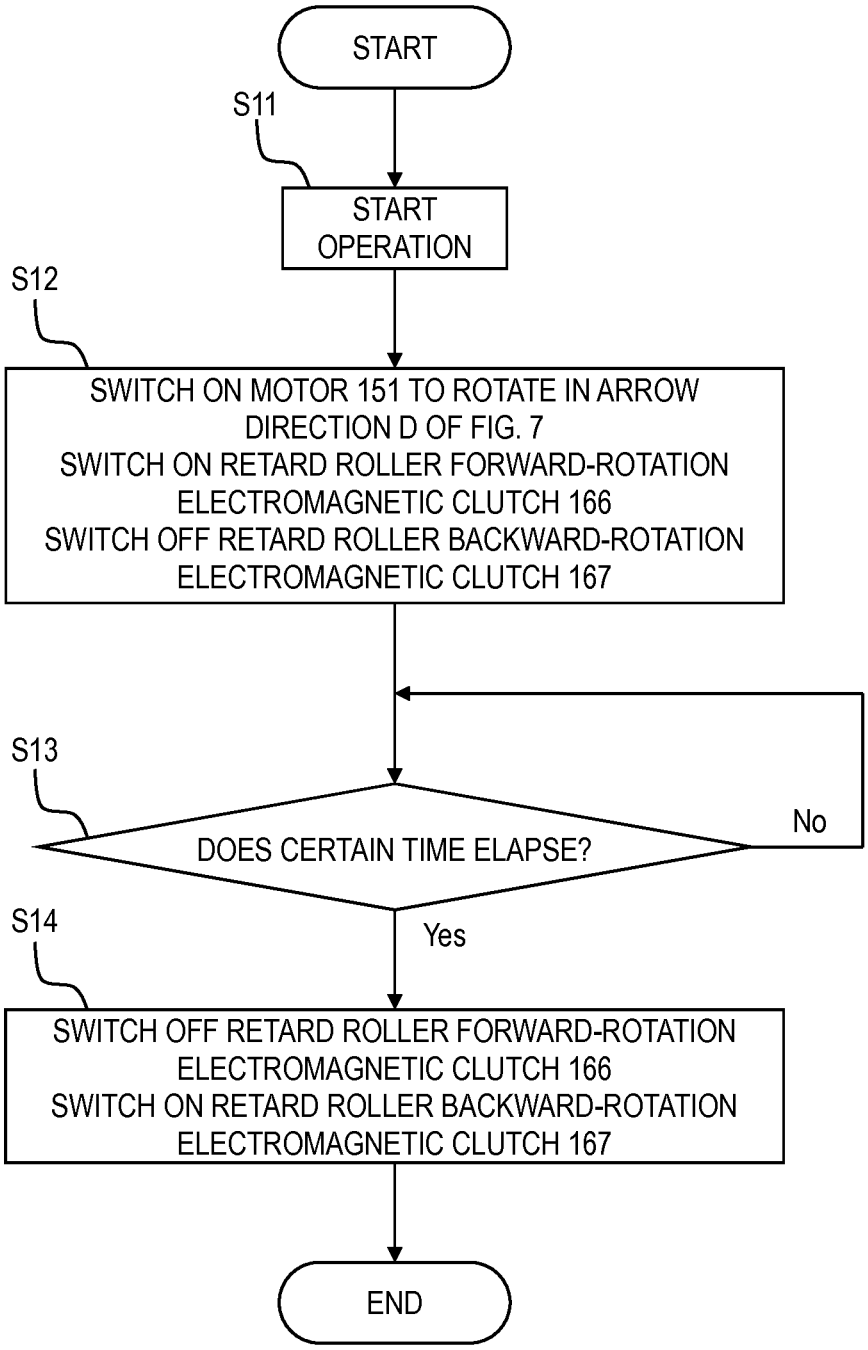
FIG. 8 is a flowchart illustrating operations according to the second embodiment.

Next, a sheet feeding operation according to the present embodiment will be described. FIG. 8 is a flowchart illustrating operations according to the present embodiment.

First, as the feeding process starts, the controller 24 starts the feeding operation (S11), so that the pickup roller 1 abuts on a sheet top surface by operating a solenoid (not illustrated). Subsequently, in step S12, the controller 24 causes the drive motor 151 to starts to rotate in the arrow direction D of FIG. 7 and causes the feed roller 2 and the pickup roller 1 to start to rotate in the sheet feeding direction.

In addition, the controller 24 performs control such that the retard roller forward-rotation electromagnetic clutch 166 is switched on, and the retard roller backward-rotation electromagnetic clutch 167 is switched off, so that the second shaft 163 has a free state, and the retard roller drive shaft 106 is forwardly rotated in the arrow direction E of FIG. 7. As a result, the feed roller 2, the pickup roller 1, and the retard roller 3 are rotated in the sheet feeding direction at the same time.

In this case, a circumferential velocity of the retard roller 3 in the sheet feeding direction is set to be faster than that of the feed roller 2. Therefore, similar to the first embodiment, the lower sheet 302 moves ahead of the upper sheet 301 in the sheet feeding direction.

A leading end of the sheet fed by the pickup roller 1 reliably enters the roller nip portion N. Furthermore, in step S13, the controller 24 performs control such that the forward-rotation electromagnetic clutch 166 is switched off, and the backward-rotation electromagnetic clutch 167 is switched on (S14) at a predetermined timing, that is, when the leading end of the sheet enters the roller nip portion N after a predetermined time elapses from the start of rotation of the drive motor 151. As a result, while the feed roller 2 and the pickup roller 1 are rotated in the sheet feeding direction, the retard roller drive shaft 106 is rotated in the arrow direction F (anti-sheet feeding direction) of FIG. 7.

Similar to the first embodiment, according to the present embodiment, the temporarily separated cutting failure portions are not exactly overlapped and engaged with each other. Therefore, the cutting failure portions 303 and 304 of the upper and lower sheets are not engaged with each other. Therefore, the sheets are reliably separated and fed one by one.

Similar to the first embodiment, according to the present invention, in a case where the sheet has the cutting failure portion 303 or 304 of FIG. 9B or 9C, the cutting failure portions 303 and 304 are not engaged with each other when the retard roller 3 is reversed to the anti-sheet feeding direction. For this reason, according to the present embodiment, it is also possible to reliably separate the upper and lower sheets 301 and 302.

In the aforementioned description, the gear ratio from the drive motor 151 to the retard roller 3 for rotating the retard roller 3 in a direction where the sheet is fed in the sheet feeding direction H is set to be equal to that for rotating the retard roller 3 in a direction where the sheet is fed in the anti-sheet feeding direction I. However, it may be possible to reduce a load applied to the drive motor 151 by increasing the gear ratio for rotating the retard roller 3 in a direction where the sheet is fed in the anti-sheet feeding direction I to decrease a circumferential velocity in the anti-sheet feeding direction I.

In the present embodiment described above, when a plurality of sheets is fed, the controller 24 performs control as described below. Specifically, the sheet of the retard roller 3 side protrudes ahead of the sheet of the feed roller 2 side in the sheet feeding direction by virtue of the torque limiter 10. Then, the drive portions 27, 151, 166, and 167 are controlled to rotate the retard roller 3 in a direction opposite to the sheet feeding direction. For this reason, when a plurality of sheets is fed, the sheet of the retard roller 3 side is made to protrude ahead of the sheet of the feed roller 2 side and is returned in the opposite direction. Therefore, it is possible to reliably disengage the overlapping cutting failure portions 303 and 304. As a result, it is possible to reliably separate the sheets and reliably feed every single sheet regardless of a direction of the cutting failure portion.

According to the present embodiment, a pair of electromagnetic clutches 166 and 167 is employed. Therefore, it is possible change a rotational direction of the retard roller 3 without stopping the drive motor 151. Therefore, it is possible to obtain the same effects as those of the first embodiment and improve a response of the retard roller 3.

In the first and second embodiments described above, rotation of the retard roller drive motor 114 is switched to a reverse direction, or switching is made between a pair of electromagnetic clutches 166 and 167 after a predetermined time elapses. Alternatively, for example, a detection sensor 28 that detects whether or not a sheet enters the roller nip portion N may be arranged, and the electromagnetic clutches 166 and 167 may be switched based on the sheet detection of the detection sensor 28 (refer to FIG. 7). That is, in a case where a plurality of sheets is fed by the pickup roller 1, a timing for returning the temporarily projecting sheet of the retard roller 3 side to the opposite direction is determined by the controller 24 at a time detecting the sheet using the detection sensor 28 as a detection portion.

In the present embodiment, a pair of electromagnetic clutches 166 and 167 is employed in a drive system. In addition, in the first embodiment, a pair of motors 114 and 118 is employed in a drive system. However, a configuration of the drive system is not limited thereto. Alternatively, for example, any drive system capable of switching the rotational direction of the retard roller 3 between the sheet feeding direction and the anti-sheet feeding direction may be employed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-175239, filed Aug. 7, 2012, which is hereby incorporated by reference herein in its entirety.

What is claimed is:

1. A sheet feeder comprising:

a sheet stacking portion that stacks a plurality of sheets;

a feed rotating member that feeds the sheet stacked in the sheet stacking portion;

a sheet separating portion having a first rotating member that is rotatable to convey the sheet fed by the feed rotating member in a sheet feeding direction;

a second rotating member that is rotatable to convey the sheet fed by the feed rotating member in a sheet feeding direction at a rotational velocity faster than that of the first rotating member and that is rotatable to convey the sheet fed by the feed rotating member in a direction opposite to the sheet feeding direction;

a drive portion that rotates the first rotating member to convey the sheet in the sheet feeding direction and rotates the second rotating member to convey the sheet in the sheet feeding direction or in the direction opposite to the sheet feeding direction;

a torque limiter provided between the drive portion and the second rotating member, the torque limiter configured to operate so that the second rotating member is rotated at a velocity equal to that of the first rotating member when a single sheet is conveyed by the first and second rotating members; and a controller that controls the drive portion such that the drive portion rotates the first rotating member and the second rotating member to convey the sheet in the sheet feeding direction, wherein when a plurality of sheets is fed by the feed rotating member, a leading end of the sheet conveyed by the second rotating member projects ahead of a leading end of the sheet conveyed by the first rotating member in the sheet feeding direction, and then rotates the second rotating member to convey the sheet in the direction opposite to the sheet feeding direction at a predetermined timing.

2. The sheet feeder according to claim 1, wherein the drive portion has a first drive motor that rotates the first rotating member and the feed rotating member in the sheet feeding direction, and a second drive motor that rotates the second rotating member in the sheet feeding direction and in the direction opposite to the sheet feeding direction.

3. The sheet feeder according to claim 1, wherein the drive portion has a drive motor that generates rotation in the first and second rotating members and the feed rotating member, a gear mechanism that transmits rotation from the drive motor to the first rotating member and the feed rotating member, and a clutch mechanism that transmits rotation from the drive motor to the second rotating member by switching between rotation of the sheet feeding direction and rotation of the direction opposite to the sheet feeding direction.

4. The sheet feeder according to claim 1, wherein, the controller determines the predetermined timing for returning the temporarily projecting sheet conveyed by the second rotating member to the opposite direction as a predetermined time elapsing.

5. The sheet feeder according to claim 1, wherein, the controller determines the predetermined timing for returning the temporarily projecting sheet conveyed by the second rotating member to the opposite direction based on detection of the sheet of a detecting portion.

6. An image forming apparatus comprising:

a sheet stacking portion that stacks a plurality of sheets;

a feed rotating member that feeds the sheets stacked on the sheet stacking portion;

a sheet separating portion having a first rotating member that is rotatable to convey the sheet fed by the feed rotating member in a sheet feeding direction;

a second rotating member that is rotatable to convey the sheet in the sheet feeding direction at a rotational velocity faster than that of the first rotating member and that is rotatable in a direction opposite to the sheet feeding direction;

a drive portion that rotates the first rotating member to convey the sheet in the sheet feeding direction and rotates the second rotating member to convey the sheet in the sheet feeding direction and in the direction opposite to the sheet feeding direction;

a torque limiter provided between the drive portion and the second rotating member, the torque limiter configured to operate so that the second rotating member is rotated at a velocity equal to that of the first rotating member when a single sheet is conveyed by the first and second rotating member;

a controller that controls the drive portion such that the drive portion rotates the first rotating member and the second rotating member to convey the sheet in the sheet feeding direction, wherein when a plurality of sheets is fed by the feed rotating member, a leading end of the sheet conveyed by the second rotating member projects ahead of a leading end of the sheet conveyed by the first rotating member in the sheet feeding direction, and then rotates the second rotating member to convey the sheet in the direction opposite to the sheet feeding direction at a predetermined timing; and an image forming portion that forms an image on the sheet fed by the feed rotating member from the sheet stacking portion.

7. The image forming apparatus according to claim 6, wherein the drive portion has a first drive motor that rotates the first rotating member and the feed rotating member in the sheet feeding direction, and a second drive motor that rotates the second rotating member in the sheet feeding direction and in the direction opposite to the sheet feeding direction.

8. The image forming apparatus according to claim 6, wherein the drive portion has a drive motor that generates rotation in the first and second rotating members and the feed rotating member, a gear mechanism that transmits rotation from the drive motor to the first rotating member and the feed rotating member, and a clutch mechanism that transmits rotation from the drive motor to the second rotating member by switching between rotation of the sheet feeding direction and rotation of the direction opposite to the sheet feeding direction.

9. The image forming apparatus according to claim 6, the controller determines the predetermined timing for returning the temporarily projecting sheet conveyed by the second rotating member to the opposite direction as a predetermined time elapsing.

10. The image forming apparatus according to claim 6, wherein, the controller determines the predetermined timing for returning the temporarily projecting sheet conveyed by the second rotating member to the opposite direction based on detection of the sheet of a detecting portion.

* * * * *